United States Patent [19]

Hennig

[11] Patent Number: 4,947,527

[45] Date of Patent: Aug. 14, 1990

[54] COUPLING SYSTEM FOR MODULAR ARTICLE

[75] Inventor: Michael R. Hennig, Morris Township, Morris County, N.J.

[73] Assignee: Matchbox Toys (USA) Ltd., Moonachie, N.J.

[21] Appl. No.: 327,704

[22] Filed: Mar. 23, 1989

[51] Int. Cl.[5] ..... A44B 17/00

[52] U.S. Cl. ..... 24/575; 24/662; 446/120; 446/125

[58] Field of Search ..... 24/618, 575, 578, 697, 24/662, 671, 681, 679, 680, 108; 446/120, 121, 125; 213/75 TC

[56] References Cited

U.S. PATENT DOCUMENTS

| | | | |
|---|---|---|---|
| D. 233,543 | 11/1974 | Christiansen . | |
| D. 285,814 | 9/1986 | Byers . | |
| D. 290,477 | 6/1987 | Ryaa et al. . | |
| 1,289,493 | 12/1918 | McBreen | 24/671 |
| 1,442,606 | 1/1923 | Day | 24/108 |
| 2,649,803 | 8/1953 | Andre . | |
| 2,791,868 | 5/1957 | Viken . | |
| 2,901,796 | 9/1959 | Hope | 24/108 |
| 2,961,779 | 11/1960 | Perry . | |
| 2,972,833 | 2/1961 | Grutta . | |
| 3,230,643 | 4/1963 | Mathus . | |
| 3,301,296 | 1/1967 | Meyer | 24/662 X |
| 3,461,514 | 8/1969 | Morris | 24/681 |
| 3,551,963 | 1/1971 | Mosher, Jr. et al. | 24/662 X |
| 3,611,621 | 10/1971 | Folson . | |
| 3,699,617 | 10/1972 | Hofmeister | 24/575 X |
| 3,878,588 | 4/1975 | Soto | 24/662 X |
| 4,161,806 | 7/1979 | Hennisse et al. | 24/618 X |
| 4,253,268 | 3/1981 | Mayr . | |
| 4,582,447 | 4/1986 | Itoh . | |
| 4,685,892 | 8/1987 | Gould . | |

*Primary Examiner*—James R. Brittain

*Attorney, Agent, or Firm*—Spensley Horn Jubas & Lubitz

[57] ABSTRACT

A system for coupling two parts together, the system being composed of two coupling members each fixable to a respective part, each coupling member including: a support piece; a male element projecting from the support piece; and a female element formed in the support piece to define a receptacle. The male element and the female element each has a central axis and the central axes extend parallel to one another, the male element has a cylindrical shank and a rounded tip portion each coaxial with the central axis of the male element, the tip portion having a diameter greater than that of the shank and being separated from the support piece by the shank, the female element is defined by an opening and is provided with a plurality of radially inwardly extending, resiliently deformable teeth spaced apart around the circumference of the opening and circumscribing a circle having a diameter not greater than the diameter of the shank, and the female element is formed to be mateable with the male element.

9 Claims, 1 Drawing Sheet

COUPLING SYSTEM FOR MODULAR ARTICLE

BACKGROUND OF THE INVENTION

The present invention relates to a coupling system for connecting together components of a modular article, particularly a toy.

It is known that toys composed of a variety of parts which can be assembled together in different configurations have a certain educational value, as well as providing entertainment, and a wide variety of articles of this type is available on the market.

In order to be successfully used by children, and particularly young children, the connection together of the components of such an article should require a relatively low degree of manual dexterity and the application of relatively low forces to effect both connection and disconnection. However, it is desirable that the connection, once made, be relatively secure and rigid.

While a large number of connecting structures for this purpose have already been proposed, each of them is less than ideal in one respect or another.

Thus, in the coupling structures disclosed in U.S. Design Pat. No. 290,477, and U.S. Pat. Nos. 3,611,621; 4,685,892; and 4,582,447, the coupling elements, which include projections and receptacles, are composed of cylinders of constant cross section. In order for two parts to be connected together with these coupling structures, they must first be perfectly aligned and oriented so that the axes of the projections are coaxial with those of the receptacles. The connection and disconnection operations require movements which are exactly parallel to those axes and the connected state is maintained solely by frictional forces. As the coupling elements become worn, the connections tend to loosen.

The connecting structure disclosed in U.S. Pat. No. 4,253,268 is constituted by ball and socket connectors provided in the edges of flat parts to enable connected parts to be pivoted relative to one another. A rigid connection between the parts is, therefore, neither contemplated nor possible. Generally, the connection together of two parts with this structure would require two distinct steps because it would be extremely difficult to simultaneously align each ball with a respective socket. FIG. 2 of this patent discloses a connecting structure including a projecting element having a rounded tip and an axial slit which provides the tip with a certain degree of resiliency to enable the tip to be inserted into a cylindrical passage. This arrangement provides a shaft for supporting a part which is to be capable of rotating relative to the part which is provided with the cylindrical passage.

U.S. Pat. No. 2,972,833 discloses a plastic block assembly in which two parts are connected together via projecting elements having ball-shaped ends and receptacles having a generally circular cross section. It would appear from a consideration of the drawings of this reference that the connection and disconnection of two parts would require a considerable level of force. Moreover, in all of the embodiments illustrated in this reference, any one connecting surface is provided with only type of connecting element, which limits the variety of ways in which elements can be connected together.

U.S. Pat. Nos. 2,791,868 and 2,961,779 disclose connecting structures which include one part provided with a projecting element having an enlarged end and a second part provided with a receptacle, or aperture, in the form of two conic frustums whose small bases meet at the center of the part. In the case of U.S. Pat. No. 2,791,868, the tip of each projecting element has a rounded form. In view of the form of the projecting elements and the receptacles, it would appear that connection and disconnection operations would require a considerable level of force.

U.S. Pat. No. 2,649,803 discloses a connection structure composed of snap fasteners the connection and disconnection of which would appear to require a considerable level of force.

Finally, U.S. Pat. No. 3,230,643 discloses a connecting structure in which a rod carries, at one end, a coupling 50 of generally rectangular cross section provided with a laterally extending spherical boss via which the rod can be held in an associated tubular rod having an annular constriction which is engaged by the boss.

SUMMARY OF THE INVENTION

It is an object of the present invention to provide coupling members which permit modular components to be connected together easily and with low levels of force, while, at the same time, providing a connection which is rigid and relatively secure.

Another object of the invention is to provide a coupling member whose coupling elements can be easily brought into engagement with coupling elements of an identical member.

A still further object of the invention is to provide a coupling member which provides a rigid connection even after having been subjected to a long period of use.

The above and other objects of the invention are achieved by a system for coupling two parts together, the system comprising two coupling members each fixable to a respective part, each coupling member comprising: a support piece; a male element projecting from the support piece; and a female element formed in the support piece to define a receptacle, wherein:

the male element and the female element each has a central axis and the central axes extend parallel to one another;

the male element has a cylindrical shank and a rounded tip portion each coaxial with the central axis of the male element, the tip portion having a diameter greater than that of the shank and being separated from the support piece by the shank;

the female element is defined by an opening having a circumference and is provided with a plurality of radially inwardly extending, resiliently deformable teeth spaced apart around the circumference of the opening and circumscribing a circle having a diameter not greater than the diameter of the shank; and the female element is formed to be mateable with the male element.

DESCRIPTION OF THE PREFERRED EMBODIMENTS

Figure 1:
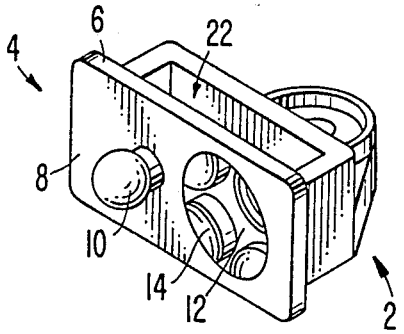
FIG. 1 is a perspective view of one embodiment of a coupling member according to the present invention.
Figure 2:
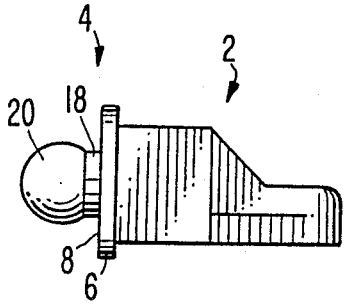
FIG. 2 is a side elevational view of the coupling member of FIG. 1.

One embodiment of a coupling member according to the invention as shown in various views in FIG. 1–6. This coupling member is preferably made of plastic and can be molded as a single piece or as a plurality of pieces which are subsequently bonded together. The coupling member includes a mounting portion 2 via which the coupling member can be mounted in a modular component and a connector portion 4 composed of a plate 6 presenting a front surface 8 from which extends a male element 10. Plate 6 is further provided with a receptacle 12 in the form of an opening, which may have a circular, square, or other suitable outline, extending completely through plate 6 and provided, around the circumference of opening 12, with a plurality of spaced teeth, or blades, 14, each having an outline preferably in the form a circular segment.

Figure 3:
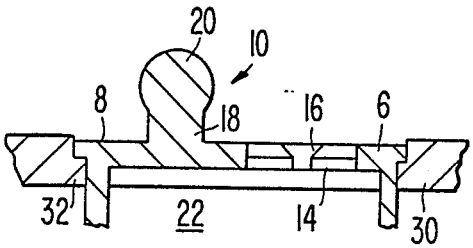
FIG. 3 is a cross-sectional detail view, taken along line 3—3 of FIG. 4, of a portion of the coupling member of FIG. 1.
Figure 4:
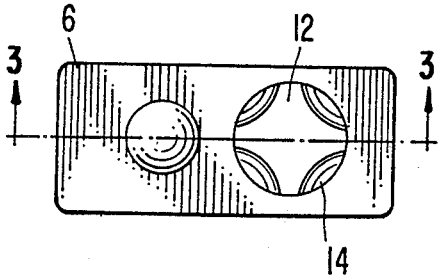
FIG. 4 is a front elevational view of the coupling member of FIG. 1.
Figure 5:
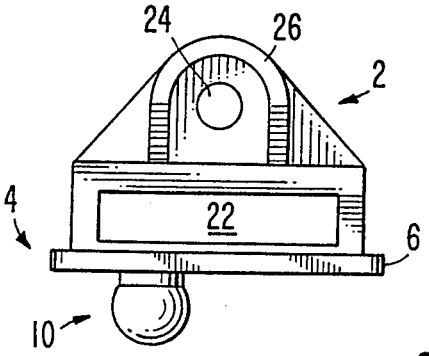
FIG. 5 is a top plan view of the coupling member of FIG. 1.
Figure 6:
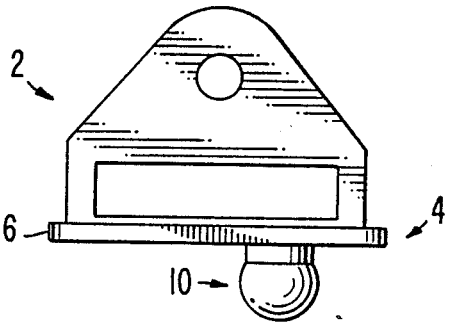
FIG. 6 is a bottom plan view of the coupling member of FIG. 1.

As shown particularly in FIG. 3, each blade 14 has a tapered, or chamfered, edge 16 at the side which extends to surface 8.

Each male portion 10 is composed of a cylindrical shank 18 and an enlarged tip 20 preferably having a spherical form.

Behind plate 8 there is provided an open region 22 for receiving the tip 20 of the male element of an identical coupling member.

Mounting portion 2 is provided with a circular opening 24, possibly surrounded by a collar 26, via which the coupling member can be mounted on a post within a modular component.

FIG. 3 shows a coupling member according to the present invention installed in a rectangular opening in a wall 30 of such a component. It can be seen that plate 6 is provided with a rim which can rest against a ledge 32 formed in wall 30. When installed in a modular component, surface 8 may be flush with the outer surface of wall 30 or it may be recessed slightly therefrom, in which case the outer surface of wall 30 would constitute the bearing surface when two components are connected together.

Preferably, the length of shank 18 is made just equal to or slightly less than the distance between the bearing surface for the coupling member, be it surface 8 or the outer surface of wall 30, and the rear surface of plate 6, or more precisely the rear surface defined by blades 14. In addition, blades 14 are dimensioned to circumscribe a circle having a diameter just slightly less than the diameter of shank 18.

When these dimensional relations are established, a shank 18 will be securely held by the blades 14 of an associated coupling member, with blades 14 being slightly deformed to provide a retaining force. In addition, enlarged tip 20 will bear against the rear surfaces of blades 14, in the region where tip 20 joins shank 18, thereby resisting movements which tend to separate two coupling members. At the same time, blades 14 are sufficiently yieldable to enable both connection and disconnection of two coupling members to be effected with a low level of force.

The chamfered surfaces 16 of blades 14 serve to facilitate positioning of each tip 20 at the entrance of the receptacle 12 of the cooperating coupling member, thereby facilitating establishment of the relative position necessary to effect a connection.

Moreover, with the arrangement according to the present invention, two coupling members can be moved into engagement even if their surfaces 8 are not precisely parallel to one another at the beginning of connection. As connection proceeds, these surfaces will automatically be brought into a parallel relation to one another, and will come to bear against one another if surface 8 is flush with, or projects slightly beyond, the outer surface of wall 30.

According to preferred embodiments of the invention, shank 18 could have a diameter of the order of 3.6 mm, while the circle circumscribed by blades 14 has a diameter of the order of 3.5 mm, i.e., shank 18 would be oversized by approximately 0.1 mm. In this specific embodiment, spherical tip portion 20 may have a diameter of the order of 4 mm, while the length of shank 18 and the thickness of plate 6 could be of the order of 1.4 mm and the circular opening defined by receptacle 12 could have a diameter of the order of 6.4 mm. Chamfer 16 could, by way of example, extend at an angle of 45° to surface 8 and each tooth 14 could have a radius of curvature of the order of 2 mm.

According to another embodiment of the invention, the opening defining receptacle 8 could be in the form of a square having one blade 14 along each side. Each side of this square could measure 5.2 mm, and the coupling member could otherwise have the other dimensions cited above, .

The material for the coupling member could be selected, in conjunction with the thickness of plate 6 and the dimensions of blades 14, to establish any desired level of connection and disconnection force.

Figure 7:
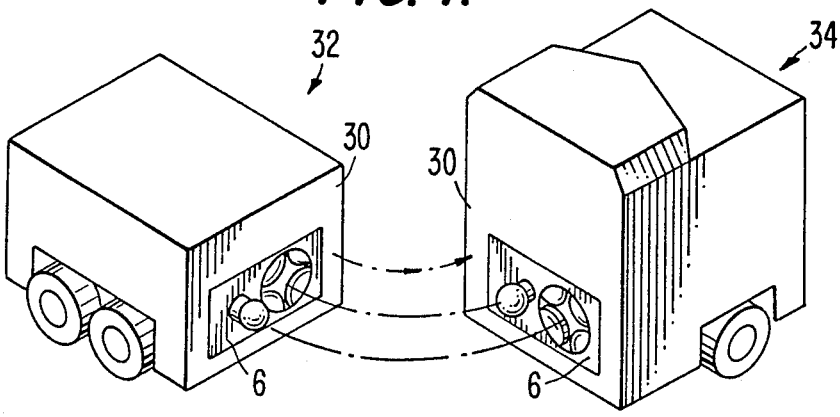
FIG. 7 is a perspective view showing two components of a modular toy, each component being equipped with an embodiment of a coupling member as shown in FIGS. 1–6.

FIG. 7 shows two modular toy components 32 and 34, each having a wall 30 provided with an opening receiving a respective coupling member according to the invention. Within each modular component, the associated coupling member is fastened to a post via opening 24 and collar 26. If the bottom of each modular component is closed by a plate secured by one or more screws, one of those screws could be simultaneously employed to retain the associated coupling member in place.

As can be seen in FIG. 7, when the two components are brought together, the positioning of each projecting element of one coupling member relative to the receptacle of the other coupling member will be aided by the chamfered edges 16 of the blades 14. This enables the coupling members to be properly positioned relative to one another with a minimum of effort, after which the two components may be pressed together in order to cause the coupling members to engage one another. While disconnection is achieved simply by pulling the two components 32 and 34 apart, it will be appreciated that until they are pulled apart, the manner in which each projecting element engages in a receptacle will establish a relatively rigid connection between components 32 and 34. Thus, the relative positions between the two components will be accurately defined either by plate surfaces 8 or by the outer surfaces of walls 30.

In further accordance with the present invention, in each coupling member, the male element is preferably spaced as far apart as possible from the female element in order to provide a more stable, and particularly a more rigid, connection between two modular components.

While the coupling member shown in the illustrated embodiment has four teeth 14, embodiments of the invention could be constructed with a different number of teeth. Coupling members according to the invention could have, for example, three to six teeth, although three to five teeth would be preferable and three or four teeth would be most suitable for producing the desired holding force.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A system for coupling two parts together, the system comprising:

two coupling members each fixable to a respective part, each coupling member comprising:

a support piece having a bearing surface, a male element projecting from the support piece and having a central axis;

a female element defining a receptacle in the support piece and having a central axis, the central axis of the male element and the central axis of the female element extending substantially parallel to one another, the male element having a substantially cylindrical shank and a rounded tip, the shank and the tip being coaxial with the central axis of the male element, the tip having a diameter greater than that of the shank and being separated from the support piece by the shank, the female element defining an opening having a circumference and being provided with a plurality of radially inwardly extending, resiliently deformable teeth spaced apart around the circumference of the opening and circumscribing a circle having a diameter not greater than the diameter of the shank, the teeth defining a rear surface, each of the coupling members having an open region adjacent the support piece for receiving the tip of the male element of the other coupling member, the shank having a diameter which is greater than the diameter of the circle circumscribed by the teeth, and the shank having a length which is less than the distance between the bearing surface of the support piece and the rear surface defined by the teeth.

2. A system as defined in claim 1 wherein each of the teeth has a chamfered edge adjacent the side of the support piece from which the male element projects.

3. A system as defined in claim 1 wherein the tip has a spherical form.

4. A system as defined in claim 1 wherein at least one of the coupling members is made of plastic.

5. A system as defined in claim 1 wherein at least one of the female elements is provided with between 3 and 6 teeth.

6. A system as defined in claim 1 wherein at least one of the coupling members further comprises a fastening portion for securing the coupling member in an associated part.

7. A system as defined in claim 6 in combination with two parts to be coupled together, with each the part having a surface and each coupling member being secured in a respective part so that the support piece is at least approximately flush with the surface of its respective part, and wherein at least one of: the surface of each the part; and the support piece of the respective coupling member defines a flat bearing surface, and the two flat bearing surfaces bear against one another when the coupling members are coupled together.

8. A system for coupling two parts together, the system comprising:

two coupling members each fixable to a respective part, each coupling member comprising a support piece having a bearing surface, two male elements, each of the male elements projecting from a support piece and having a central axis;

two female elements, each of the female elements defining a receptacle in a support piece and having a central axis, each of the male elements having a substantially cylindrical shank and a rounded tip, the shank and tip being coaxial with the central axis of the male element, the tip having a diameter greater than that of the shank and being separated from the support piece by the shank, each of the female elements defining an opening having a circumference and being provided with a plurality of radially inwardly extending, resiliently deformable teeth spaced apart around the circumference of the opening and circumscribing a circle having a diameter not greater than the diameter of the shank, the teeth defining a rear surface, at least one of the coupling members having an open region adjacent the support piece for receiving the tip of at least one of the male elements, the shank of each of the male elements having a diameter which is greater than the diameter of the circle circumscribed by the teeth, and the shank of each of the male elements having a length which is less than the distance between the bearing surface of the support piece and the rear surface defined by the teeth.

9. A system for coupling two parts together, the system comprising:

two coupling members each fixable to a respective part, each coupling member comprising a support piece having a bearing surface, a male element projecting from a support piece and having a central axis;

a female element defining a receptacle in a support piece and having a central axis, the male element having a substantially cylindrical shank and a rounded tip, the shank and the tip being coaxial with the central axis of the male element, the tip having a diameter greater than that of the shank and being separated from the support piece by the shank, the female element defining an opening having a circumference and being provided with a plurality of radially inwardly extending, resiliently deformable teeth spaced apart around the circumference of the opening and circumscribing a circle having a diameter not greater than the diameter of the shank, the teeth defining a rear surface, at least one of the coupling members having an open region adjacent the support piece for receiving the tip of the male element, the shank having a diameter which is greater than the diameter of the circle circumscribed by the teeth, and the shank having a length which is less than the distance between the bearing surface of the support piece and the rear surface defined by the teeth.

* * * * *